US008962111B2

(12) United States Patent
Zhou et al.

(10) Patent No.: US 8,962,111 B2
(45) Date of Patent: Feb. 24, 2015

(54) PRINT MEDIA COMPRISING LATEX INK FILM-FORMING AID

(75) Inventors: Xiaoqi Zhou, San Diego, CA (US); Xulong Fu, San Diego, CA (US); David Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 74 days.

(21) Appl. No.: 13/879,711

(22) PCT Filed: Oct. 25, 2010

(86) PCT No.: PCT/US2010/053961

§ 371 (c)(1),
(2), (4) Date: Apr. 16, 2013

(87) PCT Pub. No.: WO2012/057732

PCT Pub. Date: May 3, 2012

(65) Prior Publication Data

US 2013/0201268 A1 Aug. 8, 2013

(51) Int. Cl.

| | |
|---|---|
| ***B41M 5/00*** | (2006.01) |
| ***B41M 5/50*** | (2006.01) |
| ***B41M 5/52*** | (2006.01) |
| ***B41M 7/00*** | (2006.01) |
| ***B41J 2/01*** | (2006.01) |

(52) U.S. Cl.

CPC ..... *B41M 5/504* (2013.01); *B41M 5/506* (2013.01); *B41M 5/5218* (2013.01); *B41M 5/5254* (2013.01); *B41M 5/508* (2013.01); *B41M 5/502* (2013.01); *B41M 5/0023* (2013.01); *B41M 5/5227* (2013.01); *B41M 7/0054* (2013.01); *B41M 7/009* (2013.01); *B41J 2/01* (2013.01)

USPC ..... 428/32.22; 428/32.24; 428/32.25; 428/32.28; 428/32.31; 428/32.34

(58) Field of Classification Search

CPC .... B41M 5/504; B41M 5/508; B41M 5/5254; B41M 5/506; B41M 5/5218; B41M 5/502

USPC ..... 428/32.22, 32.24, 32.25, 32.28, 32.31, 428/32.34

See application file for complete search history.

(56) References Cited

U.S. PATENT DOCUMENTS

| | | | | |
|---|---|---|---|---|
| 4,489,188 | A | 12/1984 | Jones et al. | |
| 5,236,987 | A | 8/1993 | Arendt | |
| 7,432,322 | B2 | 10/2008 | Hood | |
| 7,696,262 | B2 | 4/2010 | Cagle et al. | |
| 2004/0247804 | A1 | 12/2004 | Kim et al. | |
| 2006/0205840 | A1 * | 9/2006 | Kato et al. | 523/160 |
| 2009/0014140 | A1 | 1/2009 | Dykstra | |
| 2009/0130313 | A1 | 5/2009 | Ohshima et al. | |
| 2010/0173169 | A1 | 7/2010 | Reagan et al. | |

FOREIGN PATENT DOCUMENTS

| | | |
|---|---|---|
| CN | 1795243 | 6/2006 |
| CN | 101675124 | 3/2010 |
| EP | 1190866 | 3/2002 |
| EP | 1232873 | 8/2002 |
| EP | 2050784 | 4/2009 |
| JP | 05-001254 | 1/1993 |
| JP | 06-227114 | 8/1994 |
| JP | 2009-220529 | 10/1994 |
| JP | 2002-283709 | 10/2002 |
| JP | 2002-307807 | 10/2002 |
| JP | 2003-312126 | 11/2003 |
| JP | 2004-115635 | 4/2004 |
| JP | 2005-179679 | 7/2005 |
| JP | 2007-076033 | 3/2007 |
| JP | 2007230059 | 9/2007 |
| JP | 2010-126854 | 6/2010 |

OTHER PUBLICATIONS

Duan, Hongdong et al., "Performance in Paper Coating of Styrene/Acrylate Copolymer Latex," Polym. Adv. Technol. 10, (1999) pp. 78-81.

International Search Report and Written Opinion for PCT/US2010/053961 dated Aug. 26, 2011 (8 pages).

* cited by examiner

*Primary Examiner* — Betelhem Shewareged

(74) *Attorney, Agent, or Firm* — Dierker & Associates, P.C.

(57) ABSTRACT

The present invention provides for a print media comprising an image receiving layer comprising a latex ink film-forming aid. The present invention also provides for a method of forming an image using a latex ink and a print media coated with an image receiving layer comprising a latex ink film-forming aid. The present invention also provides for a printed product comprising a latex ink printed on a print media comprising an image receiving layer comprising a latex ink film-forming aid.

16 Claims, No Drawings

PRINT MEDIA COMPRISING LATEX INK FILM-FORMING AID

BACKGROUND

Ink-jet printing has become a popular way of recording images on various media surfaces such as plain papers, coated papers, plastic films, co-extruded paper-plastic composites, textiles, indoor and outdoor banners, signage, etc. The majority of commercial ink-jet inks are water based. Because of their water-based nature, ink-jet ink systems, in general, tend to exhibit poorer image permanence and durability when exposed to water or high humidity when compared to other printing methods.

Latex ink-jet printing is a new technology in ink-jet printing. In latex ink-jet printing, the latex particulates can act as a binder, improving adhesion of pigmented colorants to the media surface. The binding power of latex particulates depends greatly upon their film-forming capability. Stronger film-forming capabilities generally correlate with better adhesion. There are, however, compromises in formulating latex inks for ink-jet printing. In particular, latexes possessing strong film-forming capabilities may enhance latex ink adhesion but may also adversely impact ink-jet architecture reliability and jettability.

DETAILED DESCRIPTION

In the present invention, it has been discovered that improved film-forming of latex ink after it is jetted onto print media can be achieved such that both ink-jet architecture reliability and jettability, and better adhesion of ink pigments, are obtained by improvements to the print media to produce an improved printed product.

The present invention provides for adding a latex ink film-forming aid into the formulation of an image receiving layer applied to a print media, rather than including the film-forming aid in the latex ink formulation. This approach is different from adding an aid or coalescent agent directly into a top coating layer such as an ink or paint formulation (U.S. Pat. Nos. 4,489,188, 5,236,987, and 7,696,262, and European Patent Appl. No. 07020568.7). The method achieves the result of causing a latex ink with less film-forming properties to become more readily film-forming at a given temperature, without the problems associated with altering the formulation of the latex ink.

A printed product with improved ink water resistance and scratch resistance is achieved by improving the adhesion to print media of ink-jet inks comprising certain ink-jet compatible latexes by coating the print media with an image receiving layer comprising one or more latex ink film-forming aids. Latex ink film-forming aids are compounds capable of reducing the film-forming temperature of ink latex particles. Because the binding power of the latex particulates in the ink is associated with the capability of film-forming, better adhesion is recognized. Thus, improvements in ink water resistance and scratch resistance are achieved without compromising the ink formulation, so that both ink-jet architecture reliability and jettability, and adhesion of ink pigments can be achieved simultaneously.

Concentrations, amounts, and other numerical data may be presented here in a range format (e.g., from 5% and 20%). It is to be understood that such range format is used merely for convenience and brevity and should be interpreted flexibly to include not only the numerical values explicitly recited as the limits of the range, but also to include all the individual numerical values or sub-ranges encompassed within that range, as if each numerical value and sub-range is explicitly recited. For example, a range of from 5% to 20% should be interpreted to include numerical values such as, but not limited to 5%, 5.5%, 9.7%, 10.3%, 15%, etc., and sub-ranges such as, but not limited to 5% to 10%, 10% to 15%, 8.9% to 18.9%, etc.

Printed Product

The present invention provides for a printed product comprising a print media and a latex ink. The print media is made of a media substrate that is at least partially coated on at least one surface with and image receiving layer comprising at least one latex ink film-forming aid, and the latex ink is printed onto the print media such that a polymeric latex of the latex ink forms a film over at least a portion of the image receiving layer of the print media. For example, a latex ink is applied by jetting droplets of ink by ink jet printing onto the print media. The ink is then dried. As used herein, a latex ink refers both to the liquid ink that is applied onto the print media and the ink after the drying process in which the aqueous portion of the ink has evaporated. The various elements comprising the printed product and the method of producing the printed product are disclosed herein.

Print Media

The printed product comprises a print media and a latex ink. The construction of the print media allows for improved latex ink adherence without compromising the ink formulation. The print media is made from a media substrate at least partially coated on at least one surface with an image receiving layer as disclosed herein. For example, where the print media is a sheet of printer paper, the image receiving layer may at least partially coat one or both sides of the sheet of paper. Alternatively, where the print media is a sheet of printer paper, the image receiving layer may completely coat one or both sides of the sheet of paper.

Media Substrate

Latex inks can be applied—for example by ink jet printing—to many surfaces, and the present invention is not limited by the type of surface comprising the media substrate. For example, the media substrate can be, but is not limited to, any kind of cellulose paper base, polymeric film base, or non-organic film base. Any recognized type of paper making pulps used for making cellulose paper base, polymeric fibers used for making polymeric films, and non-organic films may be used to make the media substrate. Representative examples for making cellulose paper base include any kind of cellulose paper made of any suitable wood or non-wood pulp. Further representative examples of suitable pulps include mechanical wood pulp, chemically ground pulp, chemi-mechanical pulp, and/or mixtures thereof. Thus, in certain embodiments, bleached hardwood chemical kraft pulps may be used to make the main pulp composition. The media substrate may also be a textile. Representative examples of polymeric resins for making polymeric film base include polyolefins such as HDPE, LDPE, LLDPE, PP, and polyolefin copolymers such as polyesters and polyamides. Where the media substrate can be characterized as base stock, the media substrate may, for example, have a basis weight of from about 60 to about 300 grams/$m^2$ (gsm).

Mineral fillers can be incorporated into the pulp used to make the media substrate. Representative examples of such fillers include ground calcium carbonate, precipitated calcium carbonate, titanium dioxide, kaolin, calcined clay, silicates, and mixtures thereof. The amount of fillers incorporated into the media substrate is not specifically limited. In certain embodiments, the media substrate incorporates from about 5% to about 20% by weight of filler. In certain embodiments, the media substrate incorporates from about 5% to about 15% by weight of filler.

When cellulose paper base is used, the base may have a low porosity so that film-forming additives do not excessively migrate into the base. Examples of methods of reducing the porosity of a cellulose paper base include surface sizing methods such as by applying a polymeric material, either natural or synthetic, on a paper web surface after the web is formed and dried. Representative examples of useful polymeric materials for reducing the porosity of cellulose paper base include starches or synthetic polymer latex. Another example is the "resin saturation" method in which polymeric resins are applied to the fiber matrix either during wet end processing or surface sizing processing. There is no specific limitation to the type of resins used as long as they are compatible with the system, especially with the wet end processing. The surface sizing process is useful for saturation since both cationic, anionic, or neutral charged resins can be employed.

Base Coating

The print media comprises at least a media substrate coated with an image receiving layer containing a latex ink film-forming aid. Before coating the media substrate with the image receiving layer, however, a "base coating" may be applied directly onto the media substrate. The image receiving layer is subsequently applied over at least part of the base coating. Considering a sheet of paper as an example media substrate, the base coating may be applied to one or both sides of the sheet and then the image receiving layer is applied to one or both side of the sheet to which the base coating was applied. A base coating provides at least two useful functions. One function is to create a smooth surface. Another function is to create a surface with a higher surface energy than the base stock (especially in cases where the substrate is highly saturated or coextruded with polymeric materials) such that a subsequently applied top image receiving layer may be firmly adhered to the base stock without needing to incorporate excessive additives such as surfactants and lubricants into the image receiving layer. Such additives may soften the latex ink film and reduce durability. An example base coating formulation comprises a mixture of any kind of inorganic particles such as calcium carbonate and clay as filler, a polymer latex as binder, and surfactants and other processing control agents.

Image Receiving Layer

The media substrate of the print media is coated on at least one surface with an image receiving layer (also referred to as an image receiving coating). The image receiving layer comprises pigments, polymeric binder, and at least one latex ink film-forming aid that reduce the film-forming temperature of the latex particulates of a latex ink.

The polymeric binder is a polymer composition that provides adhesion between the inorganic particles and other components comprising the image receiving layer, and may also provide adhesion between the image receiving layer and other layers. In certain embodiments, the polymeric binder may be a water soluble polymer. In certain embodiments, the polymeric binder may be a water dispersible polymeric latex. Representative examples of suitable polymeric binders include styrene butadiene copolymer, polyacrylates, polyvinylacetates, polyacrylic acids, polyesters, polyvinyl alcohol, polystyrene, polymethacrylates, polyacrylic esters, polymethacrylic esters, polyurethanes, copolymers thereof, and mixtures thereof.

Pigments can be organic or inorganic pigments. Representative examples of pigments include ground calcium carbonate, precipitated calcium carbonate, titanium dioxide, kaolin clay, silicates, plastic pigments, alumina trihydrate, and mixtures thereof. The physical form of the pigments can be either a powder or an aqueous pre-dispersed slurry.

Although it may be preferable in other applications that an image receiving layer for inkjet printing have a high porosity to improve ink absorption, the image receiving layer of the present invention may be constructed as "closed" pigmented coating layers. This structural characteristic can be achieved by selecting the optimum combination of at least two inorganic pigments with different particle size and size distribution. In certain embodiments, the image receiving layer comprises at least two inorganic pigments with different particle size. For example, in one embodiment a coarse pigment (e.g., calcium carbonate) with a relatively larger average particle size of from about 1.2 micrometers to about 2.0 micrometers and from about 5 $m^2/g$ to about 10 $m^2/g$ specific surface area is used as the primary pigment and another relatively finer particle size calcium carbonate with an average particle size of from about 0.5 micrometers to about 0.8 micrometers with a narrow size distribution is used to fill up the loose packing space between the primary pigment.

As used herein, size distribution is represented by an "index of particle size distribution," i.e., a size ratio according to Formula 1:

$$I=(D85/D15)^{1/2} \quad \text{(Formula 1)}$$

Where D85 is the average particle size in micrometers for which approximately 85% of particles of the pigment are smaller by size than this value according to a distribution curve, and D15 is the average particle size for which approximately 15% of particles of the pigment are smaller in size than this value. For example, the index of particle size distribution may be in the range of from about 1 to about 10. For example, the index of particle size distribution may be in the range of from about 1 to about 4.

The ratio by weight of the primary pigment to secondary pigment can be from about 95% to about 60% primary pigment to about 5% to about 40% secondary pigment. For example, from about 95% primary pigment to about 5% secondary pigment by weight, or from about 90% primary pigment to about 10% secondary pigment by weight, or from about 80% primary pigment to about 20% secondary pigment by weight, or from about 75% primary pigment to about 25% secondary pigment by weight, or from about 70% primary pigment to about 30% secondary pigment by weight, or from about 60% primary pigment to about 40% secondary pigment by weight, etc. In certain embodiments, the degree of closing level is characterized by a mercury intrusion porousimetry with pore volume less than 85%.

In certain embodiments, the image receiving layer comprises a third pigment. The third pigment is any organic or inorganic pigment with a porous structure or which can form a porous structure during solidification of the image receiving layer. The micro-porous structure of a porous pigment provides a storage space for a latex ink film-forming aid so that at least a portion of the latex ink film-forming aid remains inside of the image receiving layer structure during drying. Representative examples of pigments for inclusion in the image receiving layer include calcium carbonate, zeolite, silica, talc, alumina, aluminum trihydrate (ATH), calcium silicate, kaolin, calcined clay, and their mixtures.

Latex Ink Film-Forming Aid

At least one latex ink film-forming aid is included in the formulation of the image receiving layer of the print media. The latex inks—contemplated for use in combination with the disclosed print media to form a printed product—contain a polymeric latex as the ink binder. The polymeric latex has a film forming temperature associated glass transition temperature (Tg). In general, when latex ink is jetted onto a print media, discrete latex polymer particles are laid down on a surface, followed by a drying process. As the aqueous solvent (e.g., water) is penetrated into the base or evaporated from the droplets during the drying process, mutual repulsive forces associated with surfactants present in the ink formulation inhibit the close packing of the particles and a cubic arrangement of the particles is first formed. As the aqueous solvent continues to evaporate, the particles become closely packed with a solids volume of about 70% or higher. Capillary forces continue to force the particles together. When most of the aqueous solvent is driven from the system, the interparticular repulsive forces are overcome by increasing surface tension and the particles coalesce into a discrete film. This film-forming greatly depend upon the elastic modulus and the minimal film formation temperature (MFFT) of the latex in the ink formulation as the resistance to particle deformation. The latex MFFT for the latex ink must be selected carefully as latex possessing strong film-forming capabilities may adversely impact ink-jet architecture reliability and jettability. By adding the latex ink film-forming aid into the formulation of the print media image receiving layer, a latex ink applied to the image receiving layer with a certain film-forming capability becomes more readily film-forming at a given temperature.

The amount of latex ink film-forming aid is at least a film-forming amount. A film-forming amount is the amount capable of transferring from the image receiving layer of the print media to the liquid latex ink applied to the coated print media surface that will facilitate the formation of a continuous film upon latex ink drying. The film-forming amount will vary according to latex, formulation, and the specific film-forming aid used. An insufficient amount will not facilitate the formation of a continuous film upon latex ink drying. Too much additive (over loading), however, may soften the film strength. Therefore, although the amount of latex ink film-forming aid is at least a film-forming amount, it is preferably not so much as to overload the formulation and result in softening of the film strength. In certain embodiments, the amount of latex ink film-forming aid is from about 0.01 to about 5.0 parts by weight per 100 parts by weight of inorganic fillers. In certain embodiments, the amount of latex ink film-forming aid is from about 0.1 to about 0.5 parts by weight per 100 parts by weight of inorganic fillers.

The latex ink film-forming aid is at least partially miscible with water used as the dispersing phase in the image receiving layer formulation. In certain embodiments, the latex ink film-forming aid is completely miscible with water used as the dispersing phase in the image receiving layer formulation.

The latex ink film-forming aid has a low volatility at the drying temperature of the image receiving layer (from about 70° C. to about 100° C.) but has more volatility during latex ink curing (from about 95° C. to about 120° C.).

Chemicals useful as latex ink film-forming aids are any chemical with suitable water compatibility and temperature volatility that is capable of lowering the elastic modulus of ink latex particulates and providing temporary plasticization to promote polymer chain motion, thus enhancing latex ink film-forming. Representative examples include citrate or sebacate compounds, ethyoxy alcohols, glycol oligomers and low molecular weight polymers, glycol ether, glycerol acetals, surfactants having a more than 12 carbon backbone that are either anionic, cationic or non-ionic, and cyclic amide like lactams such as β-lactam, γ-lactam, and δ-lactam, and mixtures thereof. In certain embodiments, the latex ink film-forming aid is a cyclic amide like lactams such as β-lactam, γ-lactam, and δ-lactam, and mixtures thereof. In certain embodiments, the latex ink film-forming aid is a γ-lactam. Representative examples of a γ-lactam include N-methyl-2-Pyrrolidone, 5-methyl-2-Pyrrolidone, and 2-Pyrrolidone.

Latex Ink

Suitable inks for use in a printed product that exhibit improved adhesion in conjunction with a print media coated with an image receiving layer containing a latex ink film-forming aid are known in the art. Such inks are not particularly limited to colorant pigments, aqueous solvent, aqueous compatible co-solvent, surfactant, humectants, or biocide, but contain at least one polymeric latex. As used herein, a latex is a liquid suspension comprising a liquid (such as water and/or other liquids) and polymeric particulates from about 20 nm to about 500 nm in size and having a weight average molecular weight of from about 10,000 Mw to about 2,000,000 Mw. In certain embodiments, the polymeric particulates of the latex are from about 100 nm to about 300 nm in size. In certain embodiments, the polymeric particulates have a weight average molecular weight of from about 40,000 Mw to about 100,000 Mw.

In general, the polymeric particulate is present in the liquid at from about 0.5 wt % to about 15 wt %. Polymeric particulates can comprise a plurality of monomers that are typically randomly polymerized and can also be crosslinked. When crosslinked, the combined molecular weights of the crosslinked particulates can exceed about 2,000,000 Mw. The polymeric latex has a film-forming or glass transition temperature. In certain embodiments, this glass transition temperature is from about 20° C. to about 100° C.

Combinations of monomers may be used to form latex particulates. Representative examples of other useful monomers that may be used to form latex particulates include styrenes, C1 to C8 alkyl methacrylates, C1 to C8 alkyl acrylates, ethylene glycol methacrylates and dimethacrylates, methacrylic acids, acrylic acids, and the like. In certain embodiments, latex particulates include those prepared using an emulsion monomer mix of various weight ratios of styrene, hexyl methacrylate, ethylene glycol dimethacrylate, and methacrylic acid, which are copolymerized to form the latex. In certain embodiments, styrene and hexyl methacrylate monomers may provide the bulk of the latex particulate and ethylene glycol dimethacrylate and methyl methacrylate may be copolymerized therewith in smaller amounts. In such embodiments, an acid group is provided by methacrylic acid.

Method of Printing

The print media of the invention provides for an improved method of ink jet printing utilizing latex inks. This method of image formation comprises jetting a latex ink comprising a polymeric latex onto at least a portion of the image receiving layer of the print media of the invention.

More particularly, the image formation method comprises thermally jetting ink drops onto a print media of the invention. A liquid ink film is created from an ink droplet after one or more wetting agents, humectants, and/or additives in the ink vehicle aid in wetting the surface to allow the drop to spread. A layer is formed comprising a mixture of ink vehicle, latex polymer particles, and pigment particles. Radiant heaters and forced air in the print zone and curing zone of the printer evaporate the ink vehicle, while the heat forcibly draws the film-forming aids, at least partially or completely, into the ink layer to help the latex polymer particles to coalesce into a continuous polymer film that encapsulates the pigments to form a durable, high quality printed image.

EXAMPLES

The following disclosed embodiments are merely representative of the invention which may be embodied in various forms. Thus, specific structural, functional, and procedural details disclosed in the following examples are not to be interpreted as limiting.

In this example, the base paper was made from a cellulose fiber that contains about 78% virgin fiber, 10% of post-consumer fibers, and 12% calcium carbonate fillers. The base paper stock was surface sized using an acrylic latex resin. A base coating was applied directly to the media substrate by a pilot coater with a measuring rod. The base coating consisted of 85% by weight calcium carbonate fillers and 15% polymeric latex binder with acrylic—styrene copolymer. About 2% of additives were included in the base coating. These additives included surfactant, deformer, pH adjuster, biocide, and other processing control chemicals. Formulation in parts by weight of the image receiving layer are listed in Table 1. The image receiving layer was applied using the same methods as the base coating.

Printing tests were carried out on a HP Designjet L25500 Printer, equipped with HP latex specified as HP 789 ink cartridges. The printer was set with the conditions: heating zone temperature 50° C., cure zone temperature 110° C., and air flow 15%.

Ink adhesion testing was done using a modified ASTM D2486 scrub test. The amount of ink adhesion was determined by both visually inspecting the amount of ink removed after scrubbing and by quantitatively measuring the ink transferred to the test probe. A higher OD indicates poorer ink adhesion. Ink water durability was determined by immersing the printed sample into water and soaking for 2 minutes. The results were visually evaluated on ink running after scratching the printing surface with a wet sponge followed by shear force scratching using a stripper. Other image qualities such as gaumat or ink bleeding were measured using standard Hewlett-Packard procedures. Test results are summarized in Table 2.

TABLE 1

(parts by weight)

| | Exp 1 | Exp 2 | Exp 3 | Comparison 1 | Comparison 2 |
|---|---|---|---|---|---|
| CaCo3-(coarse) | 65 | 65 | 70 | 65 | 65 |
| Clay-(fine) | 25 | 25 | 30 | 25 | 25 |
| Porous Pigment | 10 | 10 | 0 | 10 | 10 |
| Latex Binder | 18 | 18 | 18 | 18 | 18 |
| Film-forming aid | 2-Pyrrolidone, 3pt | ESP 9147, 3pt | 2-Pyrrolidone, 3pt | 0 | Di-propylene-glycol Dimethyl ether |
| Surfactant | 0.5 | 0.5 | 0.5 | 0.5 | 0.5 |
| Defoamer | 0.1 | 0.1 | 0.1 | 0.1 | 0.1 |

TABLE 2

| | Ink running | Ink adhesion (ink OD) | Coalescence | Gamut |
|---|---|---|---|---|
| Exp 1 | 5 | 3 | V Good | 334500 |
| Exp 2 | 4 | 3.6 | V Good | 336000 |
| Exp 3 | 4+ | 5.1 | good | 334100 |
| Comparison 1 | 1 | 12.4 | good | 335000 |
| Comparison 2 | 2 | 9.7 | good | 335800 |

Ink running was evaluated by the score:
5 - No visible running ink,
4 - very minor ink running,
3 - minor ink running within acceptable level,
2 - ink running outside of acceptable level, and
1 - significant ink running.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof. It should further be understood that the embodiments disclosed herein include any and all combinations of features as disclosed herein and/or described in any of the dependent claims.

What is claimed is:

1. A printed product, comprising:

a latex ink printed on a print media, wherein the print media comprises a media substrate that is at least partially coated on at least one surface with an image receiving layer, and wherein the image receiving layer comprises at least one latex ink film-forming aid, a first inorganic filler with an average particle size ranging from about 1.2 μm to about 2.0 μm, and a second inorganic filler with an average particle size ranging from about 0.5 μm to about 0.8 μm.

2. The printed product of claim 1 wherein the media substrate comprises a cellulose paper base, polymeric film base, or non-organic film base.

3. The printed product of claim 1 wherein the at least one latex ink film-forming aid is present in an amount ranging from about 0.01 to about 5.0 parts by weight per 100 parts by weight of the first and second inorganic fillers.

4. The printed product of claim 1, wherein the latex ink comprises a polymeric latex that forms a film over at least a portion of the image receiving layer of the print media.

5. The printed product of claim 4 wherein the polymeric latex has a glass transition temperature ranging from about 20° C. to about 100° C.

6. A print media, comprising:

a media substrate at least partially coated on at least one surface with an image receiving layer, wherein the image receiving layer comprises at least one latex ink film-forming aid, a first inorganic filler with an average particle size ranging from about 1.2 μm to about 2.0 μm, and a second inorganic filler with an average particle size ranging from about 0.5 μm to about 0.8 μm.

7. The print media of claim 6 wherein the first inorganic filler and second inorganic filler are present in a ratio ranging from about 70% to about 80% by weight of the first inorganic filler to about 30% to about 20% by weight of the second inorganic filler.

8. The print media of claim 6 wherein the media substrate is at least partially coated directly on at least one surface with a base coating, wherein the base coating is at least partially coated with the image receiving layer, and wherein the base coating includes inorganic particles, a polymer latex, and a surfactant.

9. The print media of claim 6 wherein the at least one latex ink film-forming aid is present in an amount ranging from about 0.01 to about 5.0 parts by weight per 100 parts by weight of the first and second inorganic fillers.

10. The print media of claim 6 wherein the latex ink film-forming aid comprises citrate compounds, sebacate compounds, ethyoxy alcohols, a glycol oligomer, low molecular weight polymers, glycol ether, glycerol acetals, anionic, cationic, or non-ionic surfactants having a more than 12 carbon backbone, cyclic amides, or mixtures thereof.

11. A print media, comprising:

a media substrate at least partially coated on at least one surface with an image receiving layer, wherein the image receiving layer comprises at least one latex ink film-forming aid, and wherein the at least one latex film forming aid is a cyclic amide selected from the group consisting of β-lactam, γ-lactam, δ-lactam, and mixtures thereof.

12. A method of image formation, the method comprising jetting a latex ink comprising a polymeric latex onto at least a portion of the image receiving layer of the print media of claim 6.

13. The method of claim 12 wherein the image receiving layer further comprises organic or inorganic pigments and a polymeric binder, and wherein the latex ink film-forming aid comprises citrate compounds, sebacate compounds, ethyoxy alcohols, a glycol oligomer, low molecular weight polymers, glycol ether, glycerol acetals, anionic, cationic, or non-ionic surfactants having a more than 12 carbon backbone, cyclic amides, or mixtures thereof.

14. The method of claim 12 wherein the latex ink film-forming aid is a cyclic amide selected from the group consisting of β-lactam, γ-lactam, δ-lactam, and mixtures thereof.

15. The print media of claim 6 wherein the media substrate is a resin saturated substrate including a polymeric resin applied to a fiber matrix during wet end processing or surface sizing processing.

16. The print media of claim 15, further comprising a base coating coated on the resin saturated substrate, and wherein the base coating includes inorganic particles, a polymer latex binder, and a surfactant.

* * * * *